US008853930B2

(12) United States Patent
Yamada et al.

(10) Patent No.: US 8,853,930 B2
(45) Date of Patent: Oct. 7, 2014

(54) IGNITION PLUG AND METHOD OF MANUFACTURING THE SAME

(71) Applicant: NGK Spark Plug Co., Ltd., Nagoya (JP)

(72) Inventors: Tatsunori Yamada, Aichi-ken (JP); Naofumi Yamamura, Aichi-ken (JP); Kenji Ban, Gifu-ken (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/154,215

(22) Filed: Jan. 14, 2014

(65) Prior Publication Data

US 2014/0210336 A1 Jul. 31, 2014

(30) Foreign Application Priority Data

Jan. 31, 2013 (JP) ..... 2013-016299
Oct. 4, 2013 (JP) ..... 2013-208999

(51) Int. Cl.
*H01T 13/20* (2006.01)
*H01T 21/02* (2006.01)

(52) U.S. Cl.
CPC ..... *H01T 13/20* (2013.01); *H01T 21/02* (2013.01)
USPC ..... 313/143; 313/144; 445/7

(58) Field of Classification Search
CPC ..... H01T 13/20–13/39; H01T 21/02
USPC ..... 313/140–145; 445/7
See application file for complete search history.

(56) References Cited

U.S. PATENT DOCUMENTS

| | | | | |
|---|---|---|---|---|
| 6,111,345 | A * | 8/2000 | Shibata et al. | 313/141 |
| 2003/0155850 | A1* | 8/2003 | Suzuki | 313/143 |
| 2011/0043094 | A1* | 2/2011 | Suzuki | 313/144 |
| 2013/0033188 | A1* | 2/2013 | Katsuraya et al. | 313/141 |

FOREIGN PATENT DOCUMENTS

| | | | |
|---|---|---|---|
| JP | 11-233234 | 8/1999 | H01T 13/36 |
| JP | 2006-236906 | 9/2006 | H01T 21/02 |

* cited by examiner

*Primary Examiner* — Mariceli Santiago
(74) *Attorney, Agent, or Firm* — Kusner & Jaffe

(57) ABSTRACT

An ignition plug that reliably restrains generation of corona discharge for enhancing accuracy in detection of ionic current and method of manufacturing same. The ignition plug is configured such that a metallic shell and an insulator are fixed together by means of a crimped portion provided at a rear end portion of the metallic shell and bent radially inward. An electrically insulative filling member fills a space formed between the crimped portion and the insulator. The filling member covers at least a portion of an outer circumferential surface of a rear trunk portion of the insulator along the entire circumference and the entirety of a rear end surface of the metallic shell, which is a portion of the outer surface of the crimped portion and is visible from the rear side with respect to the direction of an axial line CL1.

12 Claims, 10 Drawing Sheets

IGNITION PLUG AND METHOD OF MANUFACTURING THE SAME

FIELD OF THE INVENTION

The present invention relates to an ignition plug used in an internal combustion engine or the like and also utilized for detecting ionic current, and to a method of manufacturing the ignition plug.

BACKGROUND OF THE INVENTION

An ignition plug is attached to an internal combustion engine or the like and used for igniting an air-fuel mixture or the like in a combustion chamber. Generally, the ignition plug includes an insulator having an axial hole extending in the direction of an axial line; a center electrode inserted into a forward end portion of the axial hole; a metallic shell provided externally of the outer circumference of the insulator; and a ground electrode fixed to a forward end portion of the metallic shell. The insulator is inserted into the metallic shell along the inner circumference of the metallic shell; then, a rear end portion of the metallic shell is bent radially inward to form a crimped portion, whereby the insulator is fixed to the metallic shell. Additionally, a gap is formed between a distal end portion of the ground electrode and a forward end portion of the center electrode. A high voltage is applied to the gap for generating spark discharge, thereby igniting the air-fuel mixture or the like.

Incidentally, application of voltage to the gap may be accompanied by formation of an electric field having high intensity at the crimped portion. The formation of an electric field induces a local breakdown of gas existing around the crimped portion between the crimped portion and an ionization of the gas existing around the crimped portion, potentially resulting in such generation of corona discharge as to creep along an outer circumferential surface of the insulator from the rear end of the crimped portion. The generation of corona discharge does not raise any particular problem in ignition performance. However, for a device that detects the condition of combustion of an air-fuel mixture or the like and the condition of generation of knocking by detecting ionic current that flows across the gap as a result of combustion of the air-fuel mixture or the like, the generation of corona discharge generates noise in the ionic current, potentially resulting in deterioration in accuracy in detection of the condition of combustion, etc.

Thus, in order to restrain the generation of corona discharge, there are proposed a method in which a filling layer having a relatively large resistance is provided between the crimped portion and the insulator and a method in which an electrically conductive coating electrically connected to the metallic shell is provided on that region of the insulator which faces the crimped portion. For example, refer to Japanese Patent Application Laid-Open (kokai) No. H11-233234 (Patent Document 1).

Problems to be Solved by the Invention

However, the inventors of the present invention carried out extensive studies and found that the above methods failed to sufficiently restrain the generation of corona discharge.

In recent years, in order to achieve improvement in fuel economy, etc., there has been proposed a high-compression, high-supercharge engine having a relatively high cylinder pressure. In such an engine, voltage (discharge voltage) required for generation of spark discharge is increased.

Accordingly, the electric field intensity at the crimped portion is also increased, so that the generation of corona discharge is of greater concern.

The present invention has been conceived in view of the above circumstances, and an object of the invention is to provide an ignition plug in which the generation of corona discharge can be restrained and which can provide enhanced accuracy in detection of ionic current, and a method of manufacturing the ignition plug.

SUMMARY OF THE INVENTION

Configurations suitable for achieving the above object will next be described in itemized form. When needed, actions and effects peculiar to the configurations will be described additionally.

Configuration 1. An ignition plug of the present configuration comprises a tubular metallic shell and an insulator having an axial hole extending therethrough in a direction of an axial line, provided internally of an inner circumference of the metallic shell, and having a rear trunk portion formed at a rear end portion thereof and protruding in an exposed condition from a rear end of the metallic shell. The ignition plug is configured such that the metallic shell and the insulator are fixed together by means of a crimped portion provided at a rear end portion of the metallic shell and bent radially inward, and is utilized for detecting ionic current. The ignition plug further comprises an electrically insulative filling member which fills a space formed between the crimped portion and the insulator. The filling member covers at least a portion of an outer circumferential surface of the rear trunk portion along the entire circumference and the entirety of a rear end surface of the crimped portion, which surface is a portion of an outer surface of the crimped portion and is visible from a rear side with respect to the direction of the axial line.

The "rear end surface of the crimped portion" can be said to be a surface that can first intersect with a straight line drawn in parallel with the axial line toward the crimped portion from the rear side with respect to the direction of the axial line.

Configuration 1 mentioned above can establish a condition in which almost no gas required for generation of corona discharge exists in a wide range from a rear end portion of the crimped portion having high electric field intensity. Therefore, the generation of corona discharge can be reliably restrained, whereby accuracy in detection of ionic current can be enhanced.

Configuration 2. An ignition plug of the present configuration is characterized by, in configuration 1 mentioned above, further comprising a center electrode inserted into a forward end portion of the axial hole, and a ground electrode disposed at a forward end portion of the metallic shell and forming a gap in cooperation with a forward end portion of the center electrode, and characterized in that a length L along the axial line of that portion of the filling member which is located rearward of the crimped portion is greater than a dimension G of the gap.

As the dimension G of the gap increases, electric field intensity at the rear end portion of the crimped portion increases. As a result, the possibility of generation of corona discharge increases.

In view of the above, configuration 2 mentioned above specifies that the length L along the axial line of that portion of the filling member which is located rearward of the crimped portion is greater than the dimension G of the gap. Thus, the greater the dimension G of the gap (i.e., the higher the electric field intensity at the rear end portion of the crimped portion), the wider the range from the rear end portion of the crimped portion where almost no gas exists. As a result, the generation of corona discharge can be reliably restrained.

Configuration 3. An ignition plug of the present configuration is characterized in that, in configuration 2 mentioned above, the length L is 2.5 mm or more.

According to configuration 3, there can be established a condition in which almost no gas exists in a far wider range from the rear end portion of the crimped portion. Therefore, the generation of corona discharge can be restrained more reliably.

Configuration 4. An ignition plug of the present configuration is characterized in that, in any one of configurations 1 to 3 mentioned above, the metallic shell comprises a tool engagement portion located forward of the crimped portion and having tool engagement faces on its outer circumference for allowing a tool to be engaged therewith in attachment to an internal combustion engine, and that the filling member covers the entire outer surface of the crimped portion and at least a part of a portion of an outer surface of the tool engagement portion, the portion being located between the crimped portion and the tool engagement faces.

According to configuration 4 mentioned above, there can be established a condition in which almost no gas exists in a quite wide range from the rear end portion of the crimped portion. Therefore, the effect of restraining the generation of corona discharge can be markedly enhanced.

Configuration 5. An ignition plug of the present configuration is characterized in that, in any one of configurations 1 to 4 mentioned above, the filling member is formed of resin.

According to configuration 5 mentioned above, space formed between the crimped portion and the insulator can be more reliably filled with before-curing (liquid) resin. Therefore, after the resin cures, existence of gas in the vicinity of the rear end portion of the crimped portion can be quite effectively prevented. As a result, the effect of restraining the generation of corona discharge can be reliably exhibited.

Configuration 6. An ignition plug of the present configuration is characterized in that, in any one of configurations 1 to 4 mentioned above, the filling member is formed of rubber.

According to configuration 6 mentioned above, space formed between the crimped portion and the insulator can be more reliably filled with before-curing rubber. Therefore, after the rubber cures, existence of gas in the vicinity of the rear end portion of the crimped portion can be quite effectively prevented. As a result, the effect of restraining the generation of corona discharge can be more reliably exhibited.

Also, since cured rubber is elastically deformed, in exposure to vibration resulting from operation of, for example, an internal combustion engine, formation of space (existence of gas) between the filling member and the metallic shell or the insulator can be reliably prevented. As a result, the generation of corona discharge can be restrained reliably over a long period of time.

Configuration 7. An ignition plug of the present configuration is characterized in that, in any one of configurations 1 to 6 mentioned above, the metallic shell comprises a tool engagement portion located forward of the crimped portion and allowing a tool to be engaged therewith in attachment to an internal combustion engine, and, when an outermost periphery of the filling member and an outermost periphery of the tool engagement portion are projected along the axial line onto a plane orthogonal to the axial line, a projected line of the outermost periphery of the filling member coincides with a projected line of the outermost periphery of the tool engagement portion or is located internally of the projected line of the outermost periphery of the tool engagement portion.

Configuration 7 mentioned above can prevent hindrance to engagement of a tool with the tool engagement portion which could otherwise result from existence of the filling member. Therefore, the ignition plug can be easily attached and detached, whereby workability can be improved.

Configuration 8. An ignition plug of the present configuration is characterized in that, in any one of configurations 1 to 7 mentioned above, the insulator comprises a body formed of an electrically insulative ceramic, and, at least a portion of that region of the filling member which covers an outer circumferential surface of the rear trunk portion is in direct contact with the body.

Configuration 8 mentioned above can enhance adhesion of the filling member to the insulator. Therefore, in exposure to vibration or a like situation, formation of space (existence of gas) between the insulator and the filling member can be reliably prevented. As a result, the generation of corona discharge can be restrained reliably over a long period of time.

Configuration 9. A method of manufacturing an ignition plug of the present configuration is a method of manufacturing the ignition plug mentioned in any one of configurations 1 to 8 mentioned above and comprises a filling member forming step of forming the filling member. The filling member forming step comprises a step of filling under pressure a plastic material which is to become the filling member after curing, into a cavity defined by the metallic shell, the insulator, and a mold disposed around outer circumferences of the crimped portion and the rear trunk portion.

According to configuration 9 mentioned above, a plastic material is filled under pressure into the cavity, whereby formation of air bubbles within the filling member can be restrained, and the filling member can be more reliably brought in close contact with the insulator and the metallic shell. As a result, existence of gas between the filling member and the insulator or the metallic shell can be more reliably prevented, whereby the effect of restraining the generation of corona discharge through provision of the filling member can be more reliably exhibited.

Configuration 10. A method of manufacturing an ignition plug of the present configuration is a method of manufacturing the ignition plug mentioned in any one of configurations 1 to 8 mentioned above and comprises a filling member forming step of forming the filling member. The filling member forming step comprises a step of charging a plastic material which is to become the filling member after curing, into a cavity defined by the metallic shell, the insulator, and a mold disposed around outer circumferences of the crimped portion and the rear trunk portion, and a step of performing vacuum defoaming on the plastic material.

According to configuration 10 mentioned above, vacuum defoaming is performed on the plastic material, whereby formation of air bubbles within the filling member can be restrained, and the filling member can be reliably brought in close contact with the insulator and the metallic shell. As a result, existence of gas between the filling member and the insulator or the metallic shell can be reliably prevented, whereby the generation of corona discharge can be reliably restrained.

Configuration 11. A method of manufacturing an ignition plug of the present configuration is a method of manufacturing the ignition plug mentioned in configuration 8 mentioned above, the method comprising a glaze layer forming step of forming a glaze layer on an outer circumferential surface of the body, and a glaze layer removing step of removing a portion of the glaze layer for allowing direct contact between the outer circumferential surface of the body and at least a portion of that region of the filling member which covers an outer circumferential surface of the rear trunk portion.

According to configuration 11 mentioned above, through provision of the glaze layer, while generation of abnormal discharge (flashover) creeping on the surface of the insulator is restrained, similar to the case of configuration 8 mentioned above, adhesion of the filling member to the insulator can be enhanced.

Configuration 12. A method of manufacturing an ignition plug of the present configuration is characterized in that, in configuration 11 mentioned above, the glaze layer removing step employs a sandblast process for removing the glaze layer.

According to configuration 12 mentioned above, since the sandblast process is used for removing the glaze layer, that region of the body from which the glaze layer is removed can be increased in surface roughness. Therefore, adhesion of the filling member to the insulator (body) can be further improved. As a result, the effect of restraining the generation of corona discharge can be further enhanced.

DETAILED DESCRIPTION OF THE INVENTION

Figure 1:
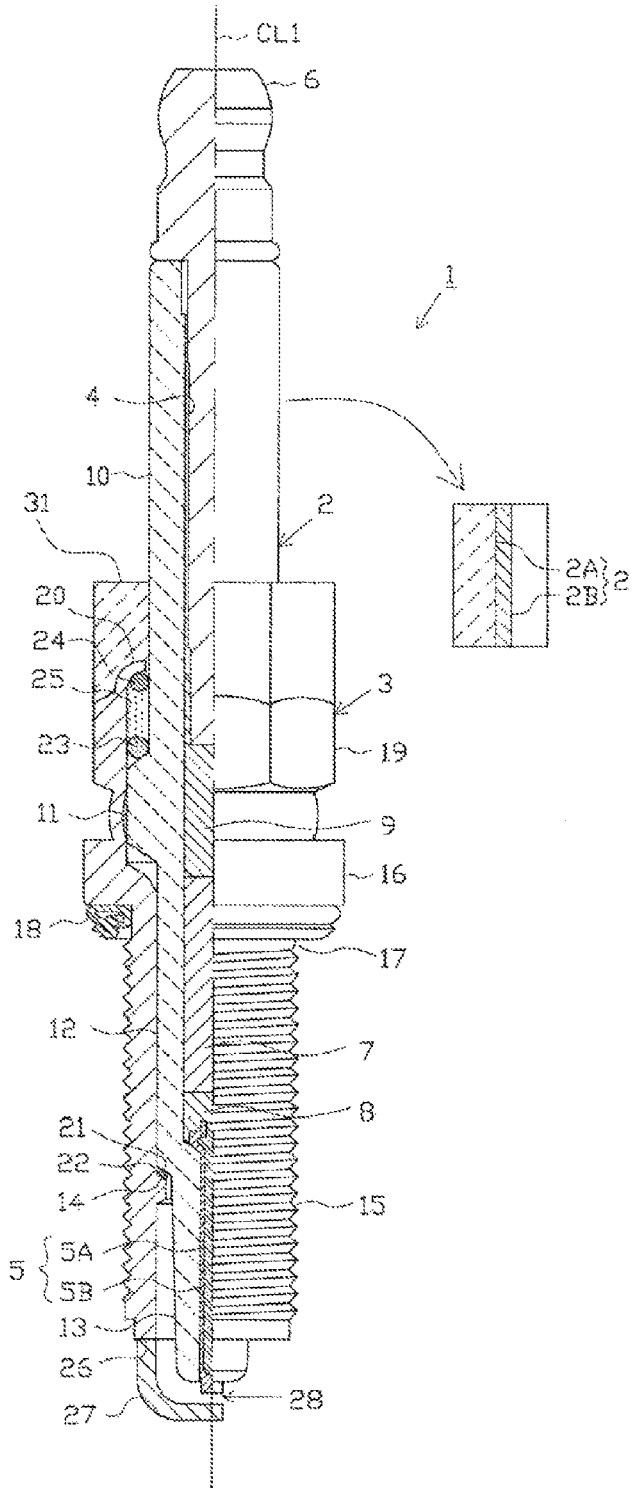
FIG. 1 is a partially cutaway front view showing the configuration of an ignition plug.

An embodiment of the present invention will next be described with reference to the drawings. FIG. 1 is a partially cutaway front view showing an ignition plug 1. The ignition plug 1 is attached to an unillustrated internal combustion engine or the like and adapted to ignite an air-fuel mixture or the like through generation of spark discharge.

In the present embodiment, the ignition plug 1 is also utilized for detecting ionic current. More specifically, the ignition plug 1 is connected to an unillustrated, predetermined voltage application device (e.g., capacitor), and, after spark discharge, the voltage application device applies voltage to a gap 28, which will be described later. At this time, ionic current which flows on the ignition plug 1 is detected by an unillustrated detection means. On the basis of the detected ionic current, misfire and knocking are detected.

Next, with reference to FIG. 1, etc., the configuration of the ignition plug 1 will be described. In FIG. 1, the direction of an axial line CL1 of the ignition plug 1 is referred to as the vertical direction. In the following description, the lower side of the ignition plug 1 in FIG. 1 is referred to as the forward side of the ignition plug 1, and the upper side as the rear side.

The ignition plug 1 includes a tubular insulator 2 and a tubular metallic shell 3, which holds the insulator 2 therein.

The insulator 2 includes a tubular body 2A formed by firing from an electrically insulative ceramic (e.g., alumina) and a glaze layer 2B provided on the outer circumferential surface of a rear end portion of the body 2A. The insulator 2, as viewed externally, includes a rear trunk portion 10 protruding in an exposed condition from the rear end of the metallic shell 3; a large-diameter portion 11 located forward of the rear trunk portion 10 and protruding radially outward; an intermediate trunk portion 12 located forward of the large-diameter portion 11 and being smaller in diameter than the large-diameter portion 11; and a leg portion 13 located forward of the intermediate trunk portion 12 and being smaller in diameter than the intermediate trunk portion 12. Additionally, the large-diameter portion 11, the intermediate trunk portion 12, and most of the leg portion 13 of the insulator 2 are accommodated within the metallic shell 3. A tapered, stepped portion 14 is formed at a connection portion between the intermediate trunk portion 12 and the leg portion 13. The insulator 2 is seated on the metallic shell 3 at the stepped portion 14.

Furthermore, the insulator 2 has an axial hole 4 extending therethrough along the axial line CL1. A center electrode 5 is fixedly inserted into a forward end portion of the axial hole 4. The center electrode 5 includes an inner layer 5A formed of a metal having excellent thermal conductivity [e.g., copper, a copper alloy, or pure nickel (Ni)], and an outer layer 5B formed of an alloy which contains nickel as a main component. The center electrode 5 assumes a rodlike (circular columnar) shape as a whole, and its forward end portion protrudes from the forward end of the insulator 2.

Additionally, an electrode terminal 6 is fixedly inserted into the rear side of the axial hole 4 in such a condition as to protrude from the rear end of the insulator 2.

Furthermore, a circular columnar resistor 7 is disposed within the axial hole 4 between the center electrode 5 and the electrode terminal 6. Opposite end portions of the resistor 7 are electrically connected to the center electrode 5 and the electrode terminal 6 via electrically conductive glass seal layers 8 and 9, respectively.

Additionally, the metallic shell 3 is formed into a tubular shape from a low-carbon steel or a like metal. The metallic shell 3 has, on its outer circumferential surface, a threaded portion (externally threaded portion) 15 adapted to attach the ignition plug 1 to, for example, an internal combustion engine. Also, the metallic shell 3 has, on its outer circumferential surface, a seat portion 16 located rearward of the threaded portion 15 and protruding radially outward. A ring-like gasket 18 is fitted to a screw neck 17 at the rear end of the threaded portion 15.

Furthermore, the metallic shell 3 has, near the rear end thereof, a tool engagement portion 19 having a hexagonal cross section. The tool engagement portion 19 has a plurality of tool engagement faces 19A (see FIG. 3) extending in parallel with the axial line CL1 and allowing a tool, such as a wrench, to be engaged therewith in attaching the metallic shell 3 to an internal combustion engine or the like. Also, the metallic shell 3 has a crimped portion 20 provided at a rear end portion thereof and bent radially inward.

Additionally, the metallic shell 3 has, on its inner circumferential surface, a tapered, stepped portion 21 adapted to allow the insulator 2 to be seated thereon. The insulator 2 is inserted forward into the metallic shell 3 from the rear end of the metallic shell 3. In a state in which the stepped portion 14 of the insulator 2 butts against the stepped portion 21 of the metallic shell 3, a rear-end opening portion of the metallic shell 3 is crimped radially inward; i.e., the crimped portion 20 is formed, whereby the insulator 2 is fixed to the metallic shell 3. An annular sheet packing 22 intervenes between the stepped portions 14 and 21. This retains airtightness of a combustion chamber and prevents outward leakage of fuel gas entering a clearance between the leg portion 13 of the insulator 2 and the inner circumferential surface of the metallic shell 3, the clearance being exposed to the combustion chamber.

Furthermore, in order to ensure airtightness which is established by crimping, annular ring members 23 and 24 intervene between the metallic shell 3 and the insulator 2 in a region near the rear end of the metallic shell 3, and a space between the ring members 23 and 24 is filled with a powder of talc 25. That is, the metallic shell 3 holds the insulator 2 via the sheet packing 22, the ring members 23 and 24, and the talc 25.

Figure 2:
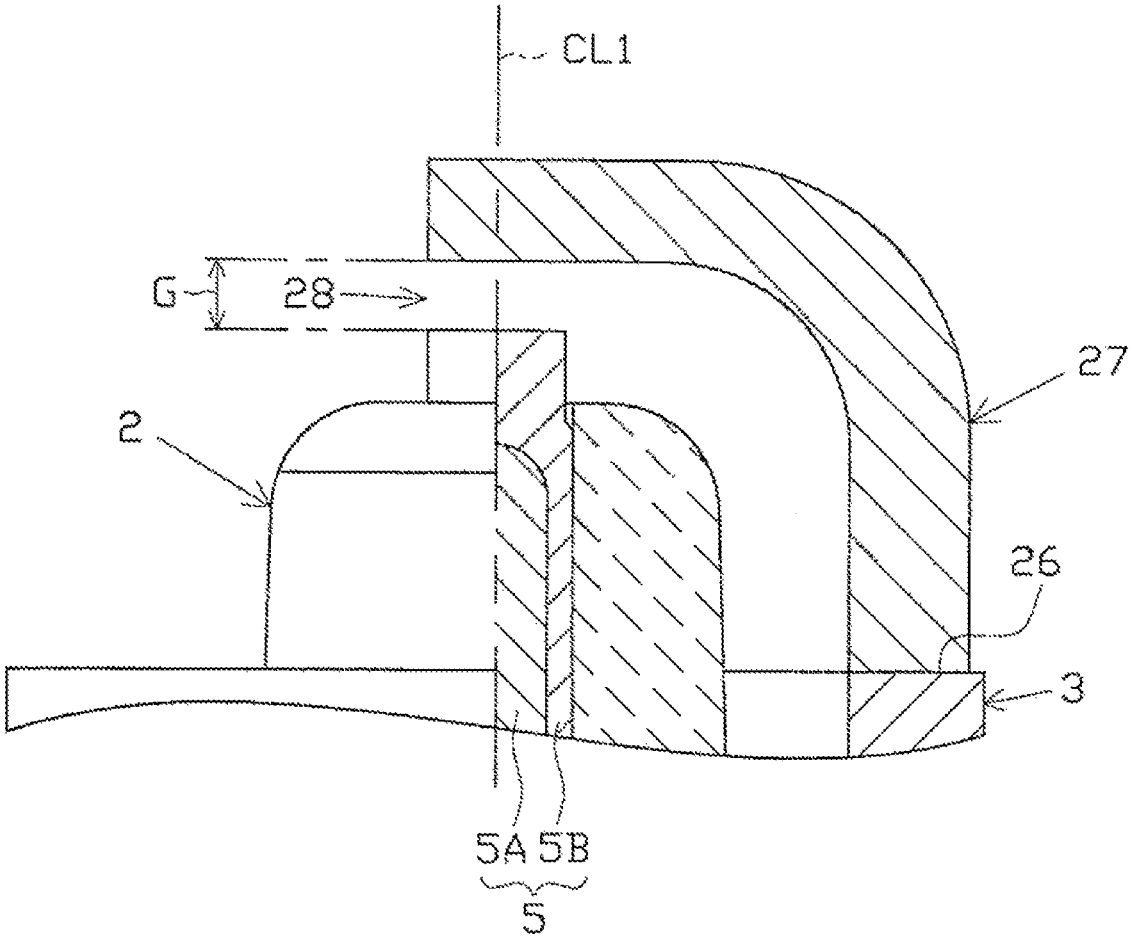
FIG. 2 is a partially cutaway, enlarged, front view showing the configuration of a forward end portion of the ignition plug.

Also, as shown in FIG. 2, a rodlike ground electrode 27 is provided at a forward end portion 26 of the metallic shell 3. The ground electrode 27 is welded at its proximal end portion to the forward end portion 26 of the metallic shell 3 and is bent at its intermediate portion such that a side surface of its distal end portion faces a forward end portion of the center electrode 5. The gap 28 is formed between the distal end portion of the ground electrode 27 and the forward end portion of the center electrode 5. Through application of voltage to the gap 28, spark discharge is performed across the gap 28 in a direction substantially along the axial line CL1. In the present embodiment, a dimension G of the gap 28 falls within a predetermined numerical range (e.g., from 0.3 mm to 2.0 mm).

Figure 3:
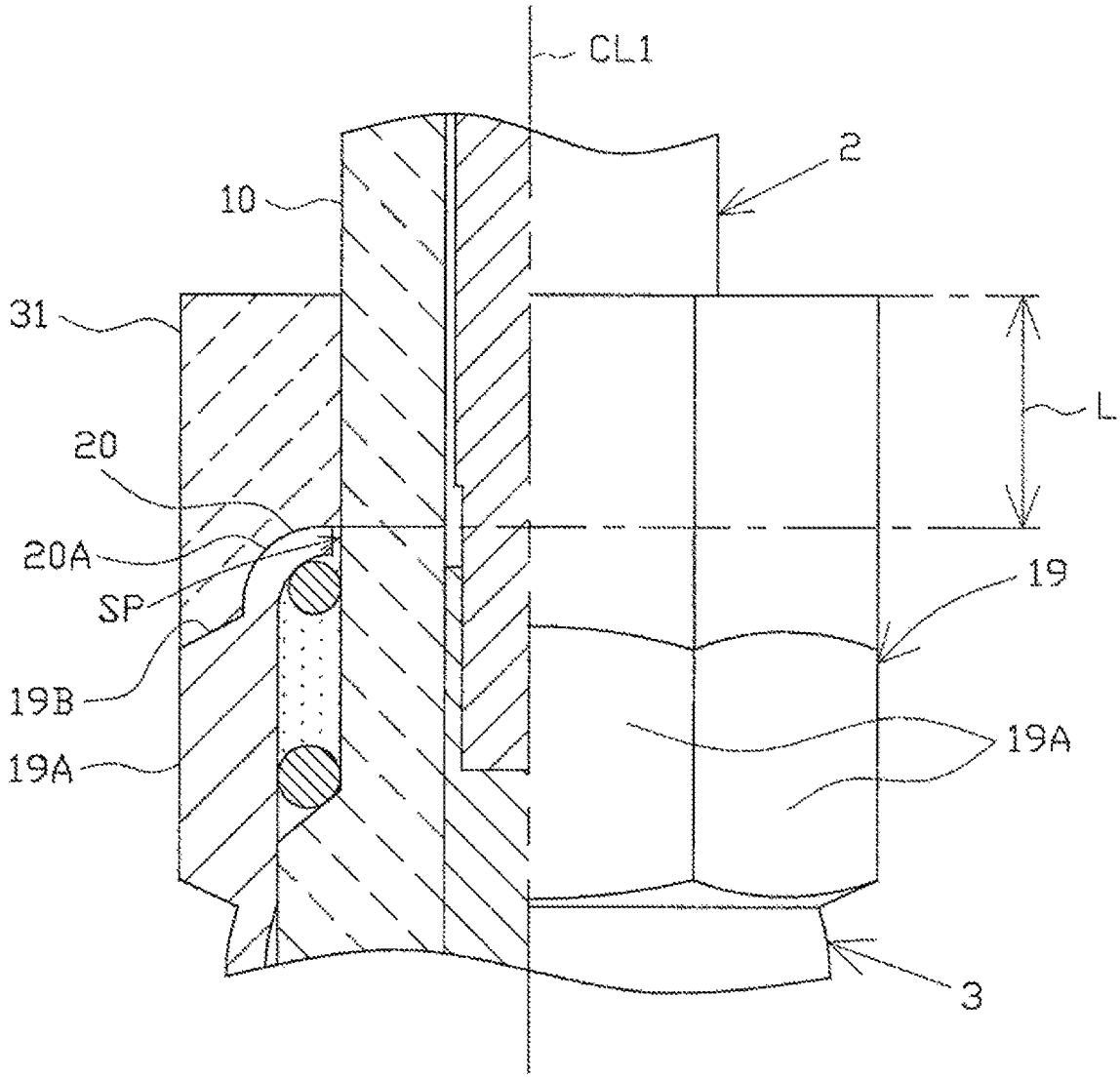
FIG. 3 is a partially cutaway, enlarged, front view showing the configuration of a filling member.

Additionally, as shown in FIG. 3, an electrically insulative filling member 31 fills a space SP formed between a rear end portion of the crimped portion 20 and an outer circumferential surface of the insulator 2. The filling member 31 is formed of an electrically insulative rubber having excellent heat resistance (e.g., silicone rubber or fluororubber) or an electrically insulative resin having excellent heat resistance (e.g., epoxy resin).

Furthermore, the filling member 31 is configured to cover at least a portion of the outer circumferential surface of the rear trunk portion 10 along the entire circumference and, of the outer surface of the crimped portion 20, the entire rear end surface 20A visible from a rear side with respect to the direction of the axial line CL1. Also, in the present embodiment, the filling member 31 covers, of the outer surface of the crimped portion 20, a surface located forward of the rear end surface 20A. As a result, the filling member 31 covers the entire outer surface of the crimped portion 20. Additionally, the filling member 31 is configured to also cover, of the outer surface of the tool engagement portion 19, an inclined surface 19B located between the crimped portion 20 and the tool engagement surfaces 19A and inclined radially outward, and forward with respect to the direction of the axial line CL1.

Also, a length L along the axial line CL1 of that portion of the filling member 31 which is located rearward of the crimped portion 20 is greater than the dimension G of the gap 28; particularly, in the present embodiment, the length L is 2.5 mm or more.

Figure 4:
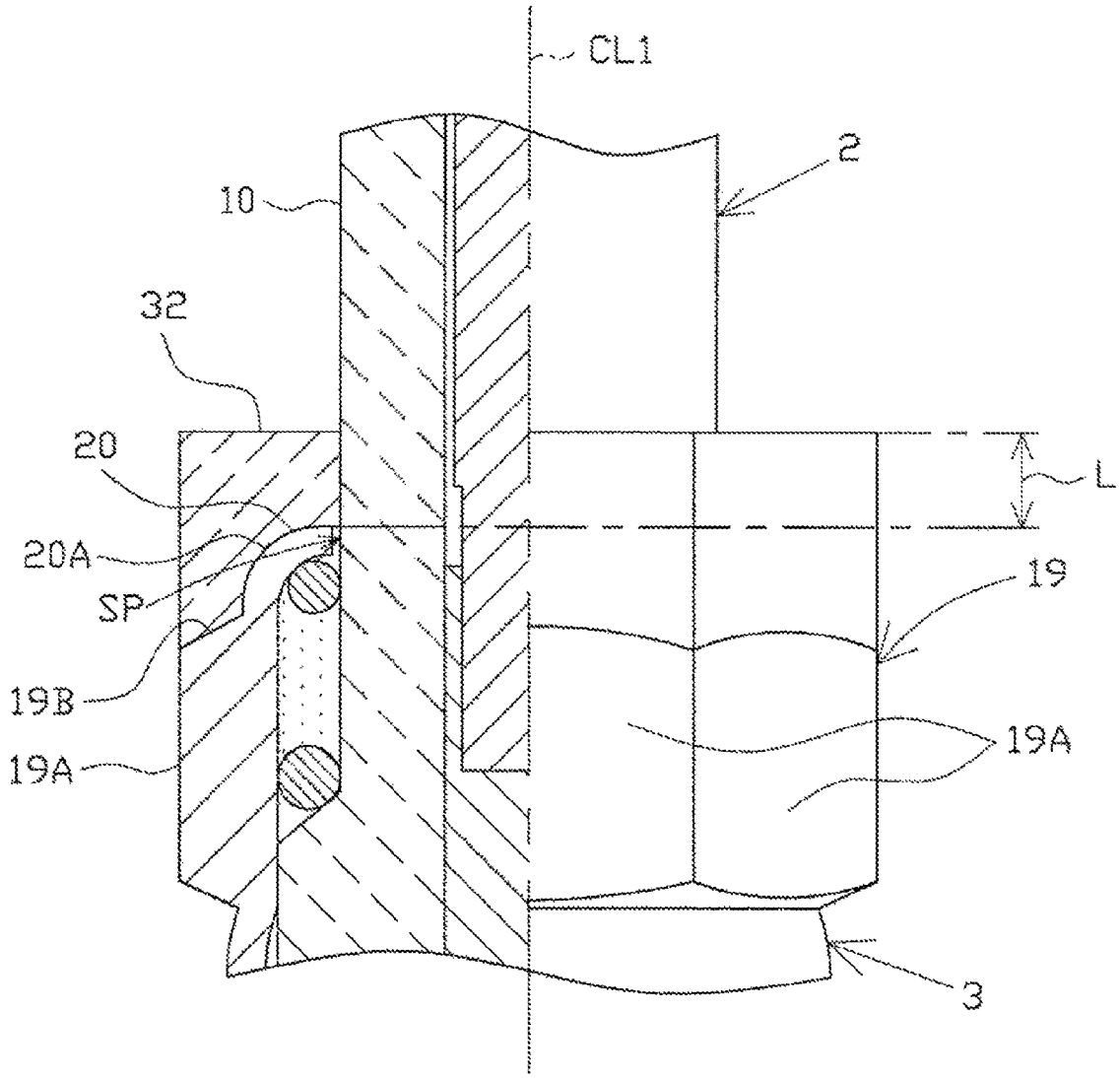
FIG. 4 is a partially cutaway, enlarged, front view showing another example of the filling member.
Figure 5:
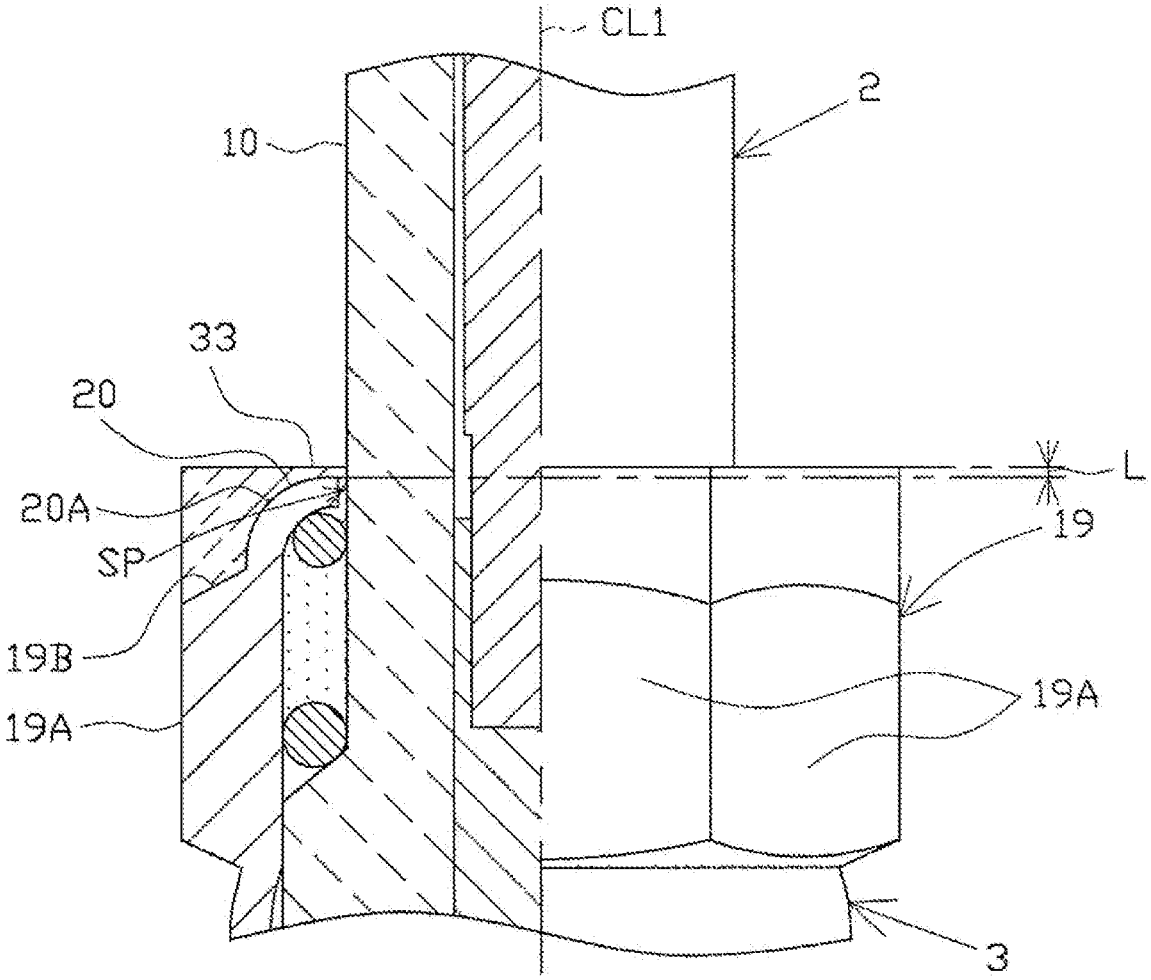
FIG. 5 is a partially cutaway, enlarged, front view showing a further example of the filling member.

The length L is not necessarily 2.5 mm or more. For example, the filling member 32 may be configured such that, as shown in FIG. 4, the length L is less than 2.5 mm. Also, the length L is not necessarily greater than the dimension G of the gap 28. For example, as shown in FIG. 5, the filling member 33 may be configured such that the length L is equal to or less than the dimension G of the gap 28.

Figure 6:
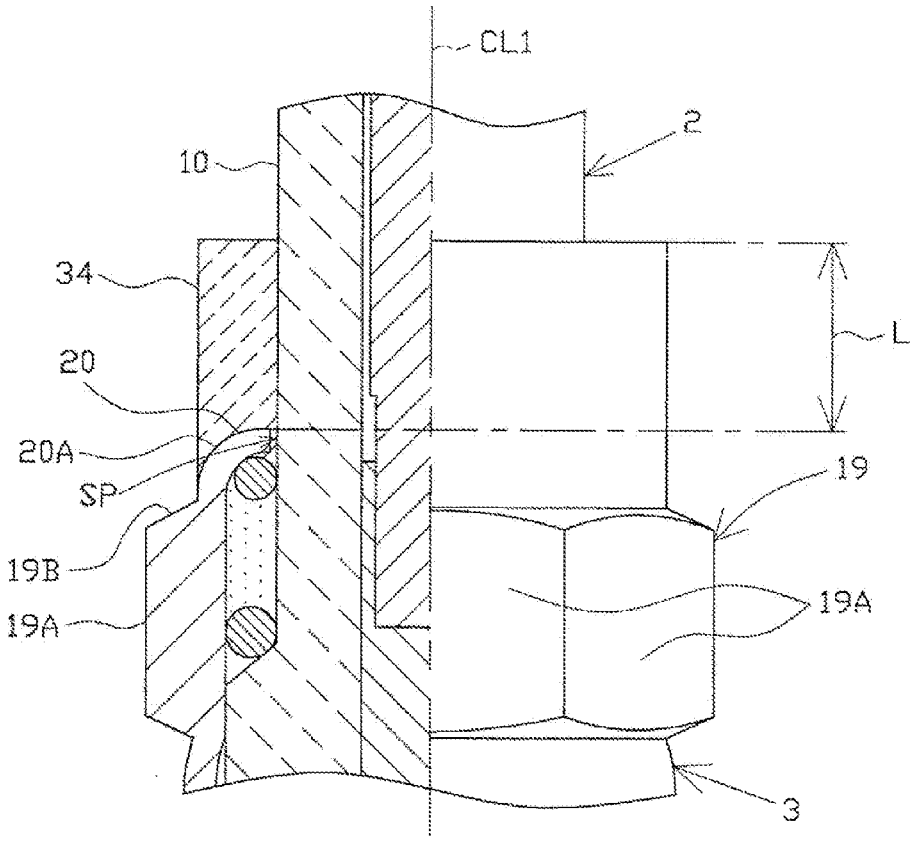
FIG. 6 is a partially cutaway, enlarged, front view showing a still further example of the filling member.

Furthermore, the filling member 31 does not necessarily cover the entire crimped portion 20 and the inclined surface 19B. As shown in FIG. 6, the filling member 34 may be configured to cover only the entire rear end surface 20A of the crimped portion 20 and an outer circumferential surface of the rear trunk portion 10.

Figure 7:
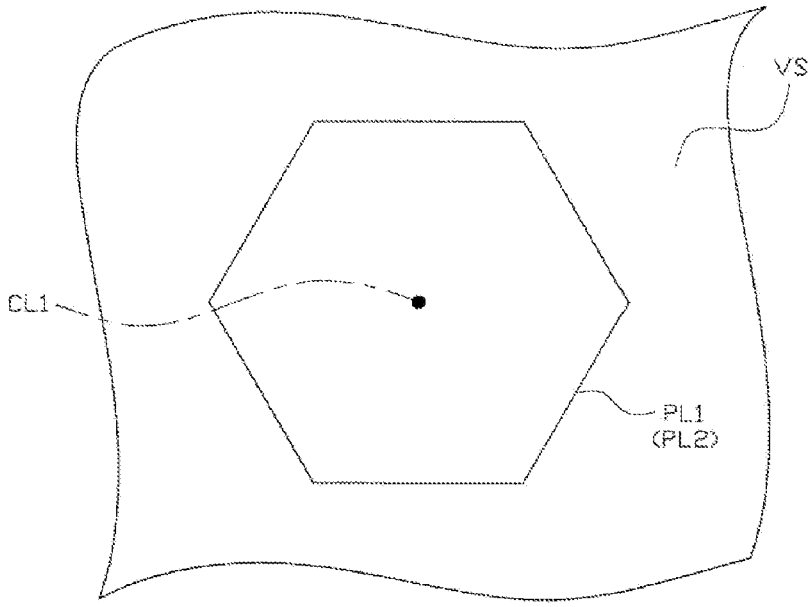
FIG. 7 is a projection view of the outermost periphery of the filling member and the outermost periphery of a tool engagement portion.

Referring back to FIG. 3, the filling member 31 in the present embodiment is configured such that its outer peripheral portion has a hexagonal cross section identical with that of an outer peripheral portion of the tool engagement portion 19. That is, as shown in FIG. 7, the filling member 31 is configured as follows: when the outermost periphery of the filling member 31 and the outermost periphery of the tool engagement portion 19 are projected along the axial line CL1 onto a plane VS orthogonal to the axial line CL1, a projected line PL1 of the outermost periphery of the filling member 31 coincides with a projected line PL2 of the outermost periphery of the tool engagement portion 19. The filling member 31 may be configured such that the projected line PL1 is located internally of the projected line PL2. That is, the filling member 31 may be configured in such a manner as not to protrude from the outer periphery of the tool engagement portion 19.

Figure 8:
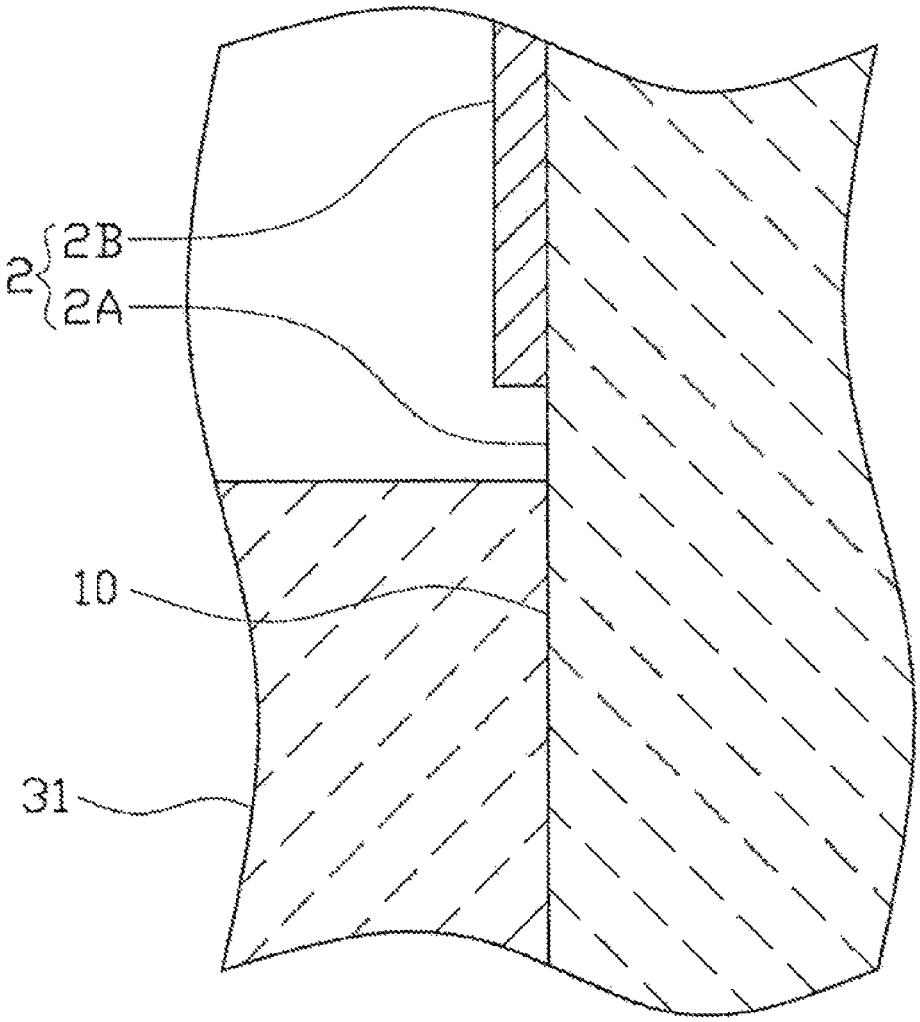
FIG. 8 is an enlarged sectional view showing a condition of contact of the filling member with a rear trunk portion.

Furthermore, in the present embodiment, as shown in FIG. 8, the rear trunk portion 10 has a glaze layer 2B on the outer circumferential surface of its rear portion, but does not have the glaze layer 2B on the outer circumferential surface of its forward portion, so that the body 2A is exposed. At least a portion of that region of the filling member 31 which covers an outer circumferential surface of the rear trunk portion 10 (in the present embodiment, the entire region which covers an outer circumferential surface of the rear trunk portion 10) is in direct contact with the body 2A. In the present embodiment, in order to restrain generation of discharge between the terminal electrode 6 and the metallic shell 3 which creeps on the outer surface of the rear trunk portion 10 (flashover), the glaze layer 2B is provided on a rear end portion of the rear trunk portion 10 over a wide range. On the other hand, in order for that entire region of the filling member 31 which covers an outer circumferential surface of the rear trunk portion 10 to come into direct contact with the body 2A (in other words, in order to prevent contact with the glaze layer 213 provided over a wide range), the length L is sufficiently small (e.g., half or less of the length along the axial line CL1 of the rear trunk portion 10).

Next will be described a method of manufacturing the thus-configured ignition plug 1.

First, the metallic shell 3 is formed beforehand. Specifically, a circular columnar metal material (e.g., an iron-based material or a stainless steel material) is subjected to cold forging, etc., so as to form a through hole and a general shape. Subsequently, machining is conducted so as to adjust the external shape, thereby yielding a metallic-shell intermediate. Then, the straight-rodlike ground electrode 27 is resistance-welded to the metallic-shell intermediate. The resistance welding is accompanied by formation of so-called "sags." After the "sags" are removed, the threaded portion 15 is formed in a predetermined region of the metallic-shell intermediate by rolling. Thus, the metallic shell 3 to which the ground electrode 27 is welded is obtained. After the formation of the threaded portion 15, in order to enhance corrosion resistance, galvanization or Ni plating may be provided on the surfaces of the metallic shell 3 and the ground electrode 27.

Also, in order to further enhance corrosion resistance, the galvanized or Ni-plated surface may be further subjected to chromate treatment.

Separately from preparation of the metallic shell 3, the body 2A is formed. For example, a forming material granular-substance is prepared by use of a material powder which contains alumina in a predominant amount, a binder, etc. By use of the prepared forming material granular-substance, a tubular green compact is formed by rubber press forming. The thus-formed green compact is subjected to grinding for shaping. The shaped green compact is fired in a kiln, thereby yielding the body 2A.

Separately from preparation of the metallic shell 3, etc., the center electrode 5 is formed. Specifically, an Ni alloy in which a copper alloy or a like metal is disposed in a central region for improving heat radiation performance is subjected to forging, thereby yielding the center electrode 5.

Next, in a heating-firing step, the body 2A and the center electrode 5, which are formed as mentioned above, the resistor 7, and the electrode terminal 6 are fixed in a sealed condition by means of the glass seal layers 8 and 9. The glass seal layers 8 and 9 are generally formed of a mixture of borosilicate glass and a metal powder; the mixture is charged into the axial hole 4 of the body 2A in such a manner that the resistor 7 is sandwiched between the charged portions of the mixture; subsequently, while being pressed from the rear side by the electrode terminal 6, the charged mixture is fired through application of heat in a kiln. Also, in the present embodiment, in the course of firing through application of heat, the glaze layer 2B is simultaneously fired on the entire outer circumferential surface of the rear trunk portion 10. That is, the heating-firing step encompasses a glaze layer forming step of forming the glaze layer 2B on the outer circumferential surface of the rear trunk portion 10. As a result of formation of the glaze layer 2B, there is yielded the insulator 2 having the body 2A and the glaze layer 2B. Also, the glaze layer forming step may be provided before or after the heating-firing step.

Next, in a glaze layer removing step, the glaze layer 2B is removed from that portion of the glaze layer 2B which is located at the forward side of the rear trunk portion 10 so as to expose the body 2A to the ambient atmosphere at the forward side of the rear trunk portion 10. By this procedure, at least a portion of that region of the filling member 31 to be provided later which covers an outer circumferential surface of the rear trunk portion 10 (in the present embodiment, the entire region which covers an outer circumferential surface of the rear trunk portion 10) can be in direct contact with the body 2A. The present embodiment employs a sandblast process for removing the glaze layer 2B.

Subsequently, the thus-manufactured insulator 2 having the center electrode 5 and the electrode terminal 6, and the thus-manufactured metallic shell 3 having the ground electrode 27 are fixed together. More specifically, in a state in which the insulator 2 is inserted through the metallic shell 3, a relatively thin-walled rear-end opening portion of the metallic shell 3 is crimped radially inward; i.e., the above-mentioned crimped portion 20 is formed, thereby fixing the insulator 2 and the metallic shell 3 together.

Figure 9:
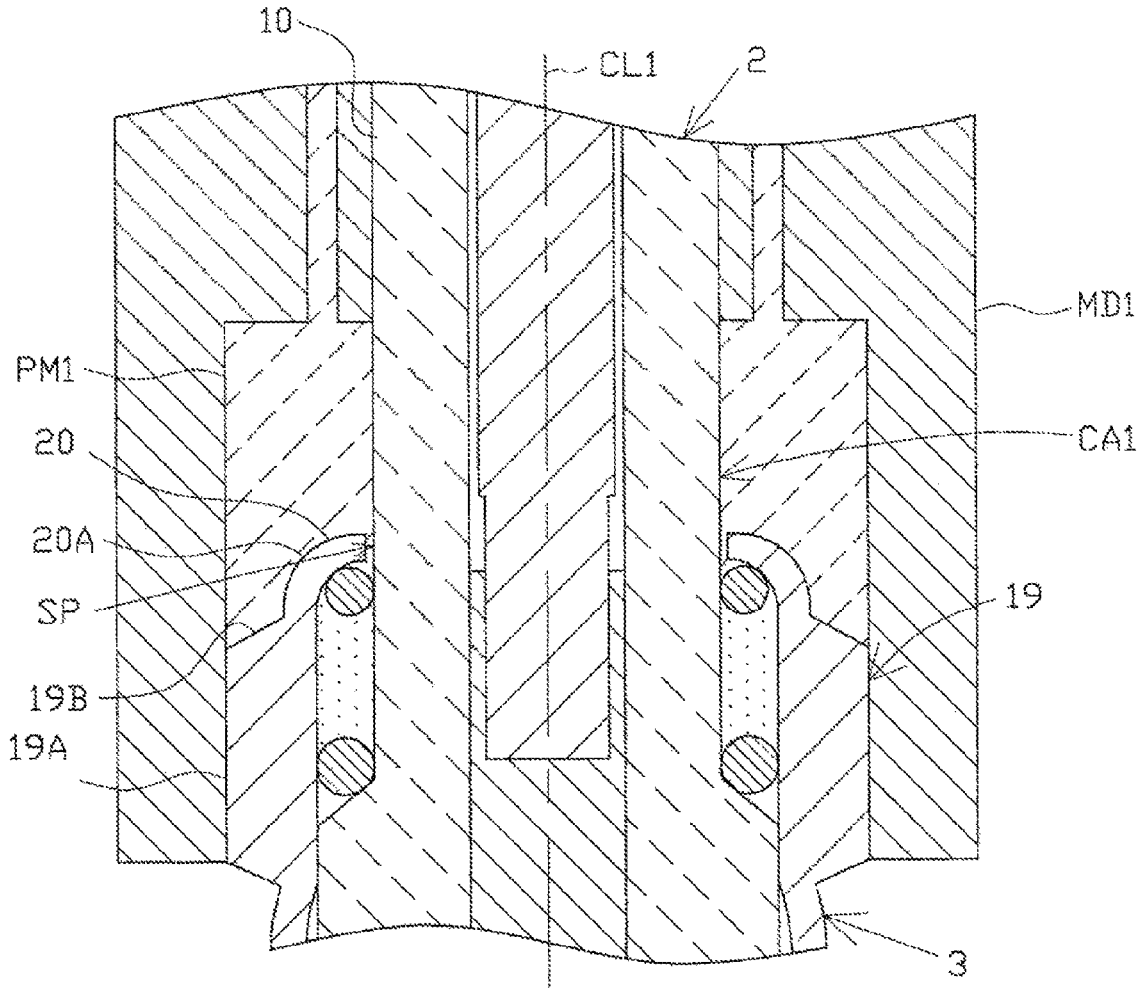
FIG. 9 is an enlarged sectional view for explaining a filling member forming step.

Next, in a filling member forming step, the filling member 31 is formed at a rear end portion of the metallic shell 3. That is, as shown in FIG. 9, first, a tubular mold MD1 whose inner circumferential surface has the same hexagonal cross section as that of the tool engagement portion 19 is disposed around the crimped portion 20 and the rear trunk portion 10. Next, by use of a predetermined extruder (not shown), a plastic material PM1 which is to become the filling member 31 after curing is filled under pressure into a cavity CA1 defined by an inner circumferential surface of the mold MD1, an outer surface of the metallic shell 3, and an outer circumferential surface of the insulator 2 (rear trunk portion 10). Subsequently, in the case where rubber is used to form the filling member 31, the plastic material PM1 is cured by vulcanization through application of hot air, high frequency waves, or the like. In the case where resin (e.g., a thermosetting resin, such as epoxy resin) is used to form the filling member 31, the plastic material PM1 is cured through application of heat. Subsequently, the mold MD1 is removed, and, for example, unnecessary portions are cut off, thereby yielding the filling member 31.

Figure 10:
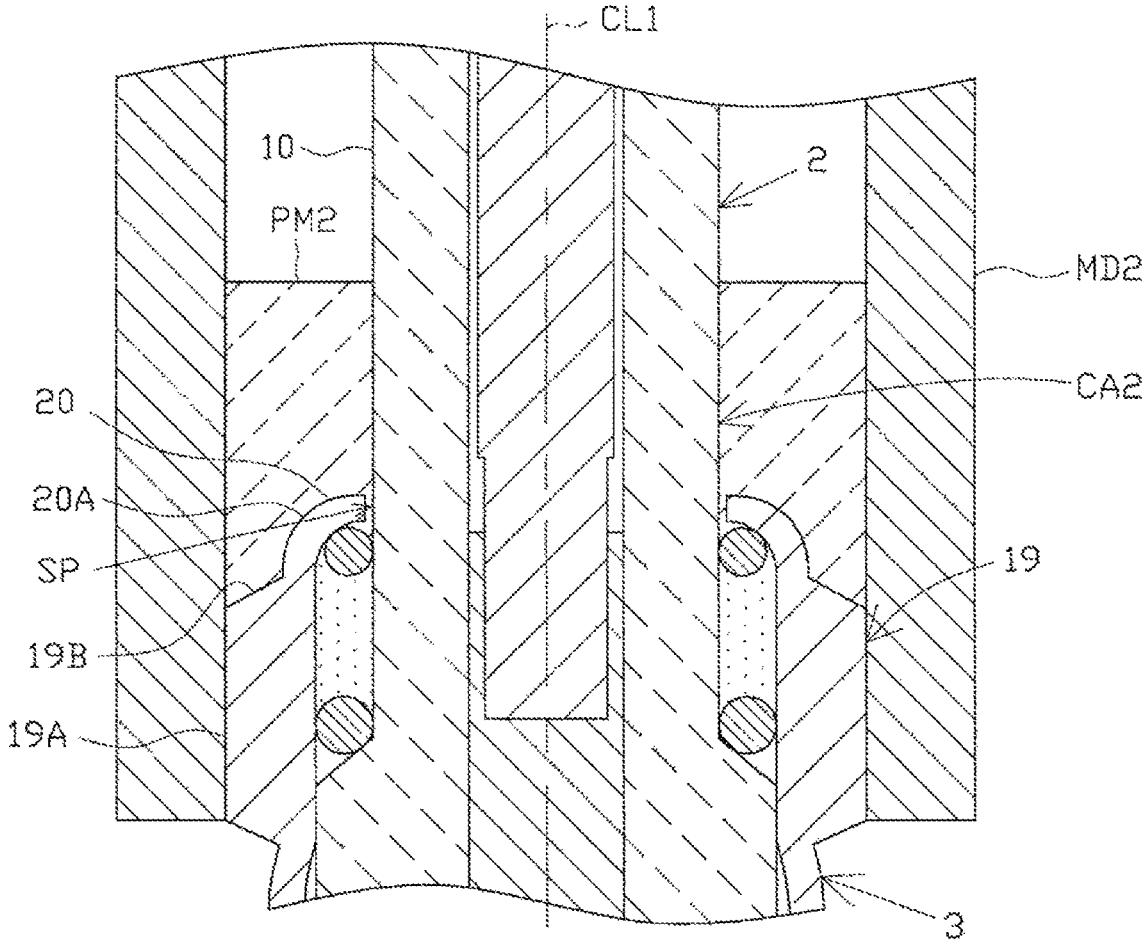
FIG. 10 is an enlarged sectional view for explaining the filling member forming step.

In the case where resin is used to form the filling member 31, the following process may be employed: as shown in FIG. 10, a plastic material PM2 which is to become the filling member 31 after curing is charged into a cavity CA2 defined by a mold MD2, the metallic shell 3, and the insulator 2 (rear trunk portion 10), and a vacuum is established around the plastic material PM2 for performing vacuum defoaming on the plastic material PM2. After vacuum defoaming, the atmospheric pressure is established again around the plastic material PM2; then, the plastic material PM2 is cured through application of heat, thereby yielding the filling member 31.

After the filling member 31 is formed, the ground electrode 27 is bent at its intermediate portion toward the center electrode 5, and the dimension of the gap 28 between the center electrode 5 and the ground electrode 27 is adjusted, thereby yielding the above-described ignition plug 1.

As described in detail above, according to the present embodiment, the filling member 31 covers at least a portion of the outer circumferential surface of the rear trunk portion 10 along the entire circumference and the entire rear end surface 20A of the crimped portion 20. Thus, there can be established a condition in which almost no gas required for generation of corona discharge exists in a wide range from a rear end portion of the crimped portion 20 having high electric field intensity. Therefore, the generation of corona discharge can be reliably restrained, whereby accuracy in detection of ionic current can be enhanced.

Particularly, in the present embodiment, the length L along the axial line CL1 of that portion of the filling member 31 which is located rearward of the crimped portion 20 is greater than the dimension G of the gap 28. Thus, the greater the dimension G of the gap 28 (i.e., the higher the electric field intensity at the rear end portion of the crimped portion 20), the wider the range from the rear end portion of the crimped portion 20 where almost no gas exists. As a result, the generation of corona discharge can be reliably restrained.

Also, since the length L is specified as 2.5 mm or more, there can be established a condition in which almost no gas exists in a far wider range from the rear end portion of the crimped portion 20. Therefore, the generation of corona discharge can be restrained far more reliably.

Furthermore, in the present embodiment, the filling member 31 covers the entire outer surface of the crimped portion 20 and the inclined surface 19B. Therefore, the effect of restraining the generation of corona discharge can be markedly enhanced.

Additionally, in the case where resin is used to form the filling member 31, the space SP can be more reliably filled with before-curing (liquid) resin. Therefore, after the resin cures, existence of gas in the vicinity of the rear end portion of the crimped portion 20 can be quite effectively prevented. As a result, the effect of restraining the generation of corona discharge can be more reliably exhibited.

Also, in the case where rubber is used to form the filling member 31, the space SP can be more reliably filled with before-curing rubber. Therefore, after the rubber cures, existence of gas in the vicinity of the rear end portion of the crimped portion 20 can be quite effectively prevented. As a result, the effect of restraining the generation of corona discharge can be more reliably exhibited. Additionally, since cured rubber is elastically deformed, in exposure to vibration resulting from operation of, for example, an internal combustion engine, formation of space (existence of gas) between the filling member 31 and the metallic shell 3 or the insulator 2 can be reliably prevented. As a result, the generation of corona discharge can be restrained reliably over a long period of time.

Also, the present embodiment is configured such that, when the outermost periphery of the filling member 31 and the outermost periphery of the tool engagement portion 19 are projected onto a plane VS orthogonal to the axial line CL1, the projected line PL1 of the outermost periphery of the filling member 31 coincides with the projected line PL2 of the outermost periphery of the tool engagement portion 19 or is located internally of the projected line PL2. Therefore, there can be prevented hindrance to engagement of a tool with the tool engagement portion 19 which could otherwise result from existence of the filling member 31. As a result, the ignition plug 1 can be easily attached and detached, whereby workability can be improved.

Also, since at least a portion of that region of the filling member 31 which covers an outer circumferential surface of the rear trunk portion 10 is in direct contact with the body 2A, adhesion of the filling member 31 to the insulator 2 can be enhanced. Therefore, in exposure to vibration or a like situation, formation of space (existence of gas) between the insulator 2 and the filling member 31 can be reliably prevented. As a result, the generation of corona discharge can be restrained reliably over a long period of time.

Also, in the filling member forming step, in the case where the plastic material PM1 is filled under pressure into the cavity CA1, the filling member 31 can be more reliably brought in close contact with the insulator 2 and the metallic shell 3. As a result, existence of gas between the filling member 31 and the insulator 2 or the metallic shell 3 can be more reliably prevented, whereby the effect of restraining the generation of corona discharge through provision of the filling member 31 can be more reliably exhibited.

Furthermore, in the filling member forming step, in the case where vacuum defoaming is performed on the plastic material PM2, similar to the case where the plastic material is filled under pressure, the filling member 31 can be more reliably brought in close contact with the insulator 2 and the metallic shell 3. As a result, existence of gas between the filling member 31 and the insulator 2 or the metallic shell 3 can be more reliably prevented, whereby the generation of corona discharge can be more reliably restrained.

Additionally, since the sandblast process is used for removing the glaze layer 2B, that region of the body 2A from which the glaze layer 2B is removed can be increased in surface roughness. Therefore, adhesion of the filling member 31 to the insulator 2 (body 2A) can be further improved. As a result, the effect of restraining the generation of corona discharge can be further enhanced.

Next, in order to verify actions and effects to be yielded by the embodiment described above, there were manufactured ignition plug samples which differed in the position of disposition of the filling member. The samples were attached to a predetermined chamber, and the pressure within the chamber was set to 0.4 MPa, 1 MPa, 2 MPa, or 4 MPa. In this condition, voltage capable of generating spark discharge was applied to the samples to check to see whether or not corona discharge was generated in such a manner as to creep on the outer circumferential surface of the rear trunk portion from a rear end portion of the metallic shell. The higher the pressure within the chamber, the higher the voltage (required voltage) capable of generating spark discharge, leading to increase in electric field intensity at a rear end portion of the crimped portion. That is, the higher the pressure within the chamber, the more likely the generation of corona discharge. Therefore, a sample free from the generation of corona discharge at a higher voltage within the chamber can be said to be more superior in the effect of restraining the generation of corona discharge. Table 1 shows whether or not corona discharge was generated in the samples. In Table 1, "Good" indicates that corona discharge was not generated, and "Poor" indicates that corona discharge was generated.

The samples were configured as follows. In sample 1, the filling member was not provided. In sample 2, the filling member was provided only in the space between the crimped portion and the insulator. In samples 3(1) and 3(2), the filling member was provided in the space and in such a manner as to cover a portion of the outer circumferential surface of the rear trunk portion along the entire circumference. In samples 4(1) to 4(6), the filling member was provided in the space and in such a manner as to cover a portion of the outer circumferential surface of the rear trunk portion along the entire circumference and the entire rear end surface of the crimped portion (similar to the configuration shown in FIG. 6). In samples 5(1) to 5(6), the filling member was provided in the space and in such a manner as to cover a portion of the outer circumferential surface of the rear trunk portion along the entire circumference; the entire outer surface of the crimped portion; and the inclined surface of the tool engagement portion (similar to the configurations shown in FIGS. 3 to 5).

Furthermore, samples 4(1) to 4(6) and 5(1) to 5(6) differed in the dimension G (mm) of the gap and the length L (mm) along the axial line of that portion of the filling member which is located rearward of the crimped portion.

TABLE 1

| | | | Evaluation | | | |
|---|---|---|---|---|---|---|
| No. | Length L (mm) | Gap dimension G (mm) | 0.4 MPA ambient pressure | 1 MPA ambient pressure | 2 MPA ambient pressure | 4 MPA ambient pressure |
| 1 | — | 0.8 | Poor | Poor | Poor | Poor |
| 2 | — | 0.8 | Poor | Poor | Poor | Poor |
| 3(1) | 1.0 | 0.8 | Poor | Poor | Poor | Poor |
| 3(2) | 1.0 | 1.1 | Poor | Poor | Poor | Poor |
| 4(1) | 1.0 | 1.1 | Good | Poor | Poor | Poor |
| 4(2) | 1.0 | 0.8 | Good | Good | Poor | Poor |
| 4(3) | 2 | 1.1 | Good | Good | Poor | Poor |
| 4(4) | 2.5 | 1.1 | Good | Good | Good | Poor |
| 4(5) | 5 | 1.1 | Good | Good | Good | Poor |
| 4(6) | 30 | 1.1 | Good | Good | Good | Good |
| 5(1) | 1.0 | 1.1 | Good | Good | Poor | Poor |
| 5(2) | 1.0 | 0.8 | Good | Good | Good | Poor |
| 5(3) | 2 | 1.1 | Good | Good | Good | Poor |
| 5(4) | 2.5 | 1.1 | Good | Good | Good | Good |
| 5(5) | 5 | 1.1 | Good | Good | Good | Good |
| 5(6) | 30 | 1.1 | Good | Good | Good | Good |

As is apparent from Table 1, samples 4(1) to 4(6) and 5(1) to 5(6), in which the filling member is provided in the space between the crimped portion and the insulator and in such a manner as to cover a portion of the outer circumferential surface of the rear trunk portion along the entire circumference and the entire rear end surface of the crimped portion, are free from the generation of corona discharge at a chamber pressure of 0.4 MPa, indicating that the samples have a good effect of restraining the generation of corona discharge. Conceivably, this is for the following reason: almost no gas required for the generation of corona discharge existed in a relatively wide range from a rear end portion of the crimped portion (i.e., in a range where electric field intensity is relatively high).

Also, the following has been confirmed: as compared with the samples in which the length L is equal to or less than the dimension G of the gap [samples 4(1) and 5(1)], the samples in which the length L is greater than the dimension G of the gap [samples 4(2) to 4(6) and 5(2) to 5(6)] can effectively restrain the generation of corona discharge even when the chamber pressure is increased; i.e., even when voltage applied to the samples is increased. A conceivable reason for this is the establishment of the following condition: the greater the dimension G of the gap, the higher the electric field intensity at the crimped portion; thus, the more likely the generation of corona discharge. However, by means of the length L being greater than the dimension G of the gap, the higher the electric field intensity at the crimped portion, the wider the range from a rear end portion of the crimped portion where almost no gas exists.

Furthermore, the following has been confirmed: the samples having a length L of 2.5 mm or more [samples 4(4) to 4(6) and 5(4) to 5(6)] have a better effect of restraining the generation of corona discharge. Conceivably, this is for the following reason: no gas existed in a far wider range from a rear end portion of the crimped portion.

Additionally, the following has been found: as compared with samples 4(1) to 4(6), the samples in which the filling member is provided in the space between the crimped portion and the insulator and in such a manner as to cover a portion of the outer circumferential surface of the rear trunk portion along the entire circumference, the entire outer surface of the crimped portion, and the inclined surface of the tool engagement portion [samples 5(1) to 5(6)] have a quite excellent effect of restraining the generation of corona discharge. Conceivably, this is for the following reason: almost no gas existed in a quite wide range from a rear end portion of the crimped portion.

From the results of the test mentioned above, preferably, in order to restrain the generation of corona discharge, the filling member is filled into the space formed between the crimped portion and the insulator and covers at least a portion of the outer circumferential surface of the rear trunk portion along the entire circumference and the entire rear end surface of the crimped portion.

Furthermore, more preferably, in view of further enhancement of the effect of restraining the generation of corona discharge, the length L is greater than the dimension G of the gap; the length L is 2.5 mm or more; and the filling member covers the entire outer surface of the crimped portion and, of the outer surface of the tool engagement portion, at least a portion of a surface located between the crimped portion and the tool engagement faces.

The present invention is not limited to the above-described embodiment, but may be embodied, for example, as follows. Of course, applications and modifications other than those exemplified below are also possible.

Figure 11:
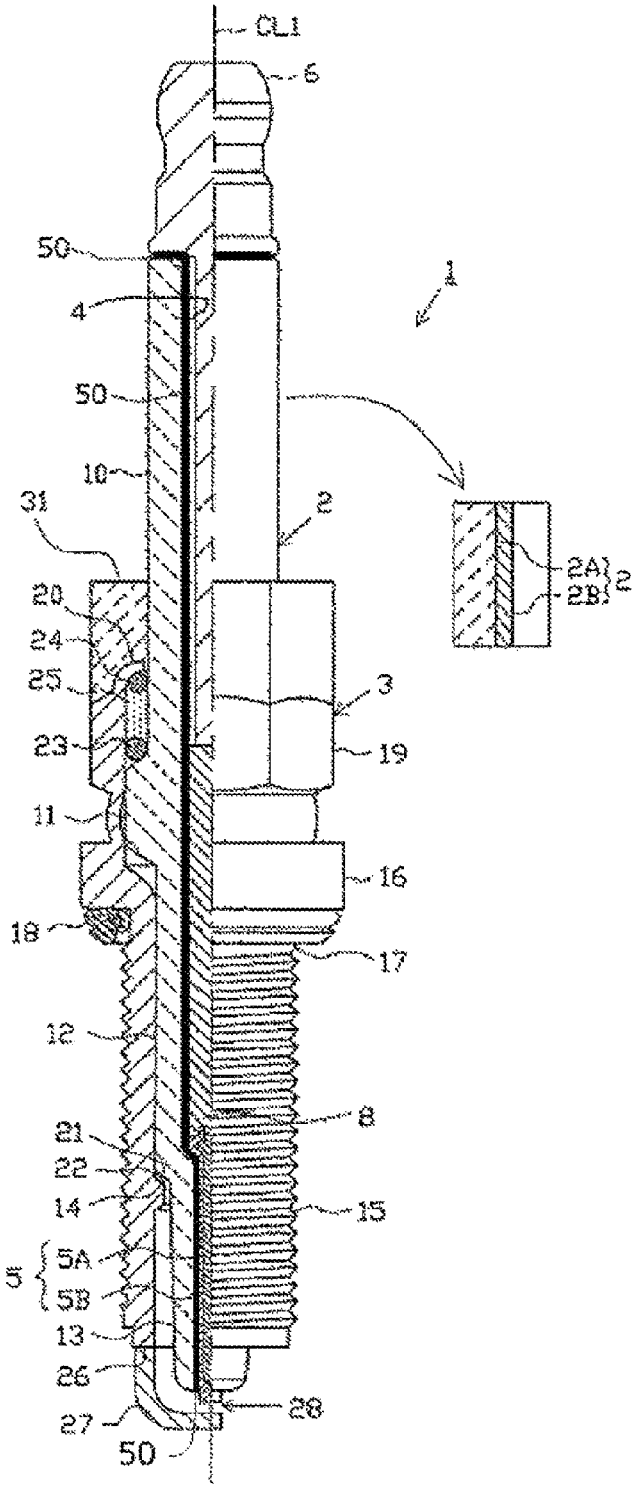
FIG. 11 is a partially cutaway front view showing another example of the ignition plug.

(a) In the embodiment described above, as shown in FIG. 11, a metal coating 50 is formed on the inner surface of the axial hole 4 of the insulator 2. The metal coating 50 is formed such that no space is generated between the metal coating 50 and the insulator 2. Meanwhile, space is provided between the metal coating 50 and the electrode terminal 6 extending through the axial hole 4 in order to absorb a thermal expansion difference between the insulator 2 and the electrode terminal 6 extending through the axial hole 4. According to the ignition plug of FIG. 11, since no space exists between the insulator 2 and the metal coating 50, there can be established a condition in which space required for generation of corona discharge does not exist between the insulator 2 and the metal coating 50. In the ignition plug of FIG. 1, space may be generated between the center electrode 5 and the insulator 2 and between the electrode terminal 6 and the insulator 2. In the case where the space is generated, corona discharge may possibly be generated between the center electrode 5 and the insulator 2 and between the electrode terminal 6 and the insulator 2. According to the ignition plug of FIG. 11, the generation of corona discharge can be more reliably restrained, so that accuracy in detection of ionic current can be enhanced. The metal coating 50 in the ignition plug of FIG. 11 is a layer formed of a metal selected from among Cu, Ni, Ag, Pt, Rh, Au, W, Co, Be, Ir, Zn, Mg, Al, and Mo, or an alloy which contains one or more of the metals as a main component.

(b) In the embodiment described above, the filling member 31 provided around the rear end portion 10 is configured to be in direct contact with the body 2A of the insulator 2. However, the filling member 31 is not necessarily in direct contact with the body 2A. Therefore, for example, in the case where the glaze layer 2B exists continuously up to a rear end portion of the large-diameter portion 11, the filling member 31 may be in contact with the glaze layer 2B.

(c) In the embodiment described above, the ground electrode 27 is joined to the forward end portion 26 of the metallic shell 3. However, the present invention is applicable to the case where a portion of a metallic shell (or, a portion of an end metal piece welded beforehand to the metallic shell) is formed into a ground electrode by machining (refer to, for example, Japanese Patent Application Laid-Open (kokai) No. 2006-236906).

(d) In the embodiment described above, the tool engagement portion 19 has a hexagonal cross section. However, the shape of the tool engagement portion 19 is not limited thereto. For example, the tool engagement portion may have a Bi-HEX (modified dodecagonal) shape [ISO22977:2005(E)] or the like.

DESCRIPTION OF REFERENCE NUMERALS

1: ignition plug;
2: insulator;
2A: body;
2B: glaze layer;
3: metallic shell;
4: axial hole;
5: center electrode;
10: rear trunk portion;
19: tool engagement portion;
19A: tool engagement face;
20: crimped portion;
28: gap;
31: filling member;
CA1, CA2: cavity;
CL1: axial line;
MD1, MD2: mold;
PM1, PM2: plastic material; and
SP: space.

Having described the invention, the following is claimed:

1. An ignition plug utilized for detecting ionic current, the ignition plug comprising:

a tubular metallic shell;

an insulator having an axial hole extending therethrough in a direction of an axial line, provided internally of an inner circumference of the metallic shell, and having a rear trunk portion formed at a rear end portion thereof and protruding in an exposed condition from a rear end of the metallic shell, wherein the metallic shell and the insulator are fixed together by means of a crimped portion provided at a rear end portion of the metallic shell and bent radially inward; and an electrically insulative filling member which fills a space formed between the crimped portion and the insulator, wherein the filling member covers at least a portion of an outer circumferential surface of the rear trunk portion along the entire circumference and the entirety of a rear end surface of the crimped portion, which surface is a portion of an outer surface of the crimped portion and is visible from a rear side with respect to the direction of the axial line.

2. An ignition plug according to claim 1, further comprising:

a center electrode inserted into a forward end portion of the axial hole; and a ground electrode disposed at a forward end portion of the metallic shell and forming a gap in cooperation with a forward end portion of the center electrode, wherein a length L along the axial line of that portion of the filling member which is located rearward of the crimped portion is greater than a dimension G of the gap.

3. An ignition plug according to claim 2, wherein the length L is 2.5 mm or more.

4. An ignition plug according to claim 1, wherein the metallic shell comprises a tool engagement portion located forward of the crimped portion and having tool engagement faces on its outer circumference for allowing a tool to be engaged therewith in attachment to an internal combustion engine, and the filling member covers the entire outer surface of the crimped portion and at least a part of a portion of an outer surface of the tool engagement portion, the portion being located between the crimped portion and the tool engagement faces.

5. An ignition plug according to claim 1, wherein the filling member is formed of resin.

6. An ignition plug according to claim 1, wherein the filling member is formed of rubber.

7. An ignition plug according to claim 1, wherein the metallic shell comprises a tool engagement portion located forward of the crimped portion and allowing a tool to be engaged therewith in attachment to an internal combustion engine, and when an outermost periphery of the filling member and an outermost periphery of the tool engagement portion are projected along the axial line onto a plane orthogonal to the axial line, a projected line of the outermost periphery of the filling member coincides with a projected line of the outermost periphery of the tool engagement portion or is located internally of the projected line of the outermost periphery of the tool engagement portion.

8. An ignition plug according to claim 1, wherein the insulator comprises a body formed of an electrically insulative ceramic, and at least a portion of that region of the filling member which covers an outer circumferential surface of the rear trunk portion is in direct contact with the body.

9. A method of manufacturing an ignition plug utilized for detecting ionic current, the ignition plug comprising:

a tubular metallic shell;

an insulator having an axial hole extending therethrough in a direction of an axial line, provided internally of an inner circumference of the metallic shell, and having a rear trunk portion formed at a rear end portion thereof and protruding in an exposed condition from a rear end of the metallic shell, wherein the metallic shell and the insulator are fixed together by means of a crimped portion provided at a rear end portion of the metallic shell and bent radially inward; and an electrically insulative filling member which fills a space formed between the crimped portion and the insulator, wherein the filling member covers at least a portion of an outer circumferential surface of the rear trunk portion along the entire circumference and the entirety of a rear end surface of the crimped portion, which surface is a portion of an outer surface of the crimped portion and is visible from a rear side with respect to the direction of the axial line, said method comprising:

a filling member forming step of forming the filling member, wherein the filling member forming step comprises:

a step of filling under pressure a plastic material which is to become the filling member after curing, into a cavity defined by the metallic shell, the insulator, and a mold disposed around outer circumferences of the crimped portion and the rear trunk portion.

10. A method of manufacturing an ignition plug utilized for detecting ionic current, the ignition plug comprising:

a tubular metallic shell;

an insulator having an axial hole extending therethrough in a direction of an axial line, provided internally of an inner circumference of the metallic shell, and having a rear trunk portion formed at a rear end portion thereof and protruding in an exposed condition from a rear end of the metallic shell, wherein the metallic shell and the insulator are fixed together by means of a crimped portion provided at a rear end portion of the metallic shell and bent radially inward; and an electrically insulative filling member which fills a space formed between the crimped portion and the insulator, wherein the filling member covers at least a portion of an outer circumferential surface of the rear trunk portion along the entire circumference and the entirety of a rear end surface of the crimped portion, which surface is a portion of an outer surface of the crimped portion and is visible from a rear side with respect to the direction of the axial line, said method comprising:

a filling member forming step of forming the filling member, wherein the filling member forming step comprises:

a step of charging a plastic material which is to become the filling member after curing, into a cavity defined by the metallic shell, the insulator, and a mold disposed around outer circumferences of the crimped portion and the rear trunk portion; and a step of performing vacuum defoaming on the plastic material.

11. A method of manufacturing an ignition plug utilized for detecting ionic current, the ignition plug comprising:

a tubular metallic shell;

an insulator having an axial hole extending therethrough in a direction of an axial line, provided internally of an inner circumference of the metallic shell, and having a rear trunk portion formed at a rear end portion thereof and protruding in an exposed condition from a rear end of the metallic shell, wherein the metallic shell and the insulator are fixed together by means of a crimped portion provided at a rear end portion of the metallic shell and bent radially inward; and an electrically insulative filling member which fills a space formed between the crimped portion and the insulator, wherein the filling member covers at least a portion of an outer circumferential surface of the rear trunk portion along the entire circumference and the entirety of a rear end surface of the crimped portion, which surface is a portion of an outer surface of the crimped portion and is visible from a rear side with respect to the direction of the axial line, and wherein the insulator comprises a body formed of an electrically insulative ceramic, and at least a portion of that region of the filling member which covers an outer circumferential surface of the rear trunk portion is in direct contact with the body, said method comprising:

a glaze layer forming step of forming a glaze layer on an outer circumferential surface of the body; and a glaze layer removing step of removing a portion of the glaze layer for allowing direct contact between the outer circumferential surface of the body and at least a portion of that region of the filling member which covers an outer circumferential surface of the rear trunk portion.

12. A method of manufacturing an ignition plug according to claim 11, wherein the glaze layer removing step employs a sandblast process for removing the glaze layer.

* * * * *